US009395107B2

(12) United States Patent
Asari et al.

(10) Patent No.: US 9,395,107 B2
(45) Date of Patent: Jul. 19, 2016

(54) COMBINED CASCADE REFRIGERATION CYCLE APPARATUS

(71) Applicant: Toshiba Carrier Corporation, Kanagawa (JP)

(72) Inventors: Shun Asari, Fuji (JP); Takahiro Zushi, Fuji (JP); Takahisa Endo, Fuji (JP)

(73) Assignee: TOSHIBA CARRIER CORPORATION, Kanagawa (JP)

( * ) Notice: Subject to any disclaimer, the term of this patent is extended or adjusted under 35 U.S.C. 154(b) by 211 days.

(21) Appl. No.: 14/186,810

(22) Filed: Feb. 21, 2014

(65) Prior Publication Data

US 2014/0165642 A1 Jun. 19, 2014

Related U.S. Application Data

(63) Continuation of application No. PCT/JP2012/071167, filed on Aug. 22, 2012.

(30) Foreign Application Priority Data

Aug. 22, 2011 (JP) ..... 2011-180275

(51) Int. Cl.
*F25B 7/00* (2006.01)
*F25B 30/02* (2006.01)
(Continued)

(52) U.S. Cl.
CPC . *F25B 7/00* (2013.01); *F25B 13/00* (2013.01); *F25B 30/02* (2013.01); *F25B 47/025* (2013.01); *F25B 2339/047* (2013.01); *F25B 2347/021* (2013.01); *F25B 2400/06* (2013.01)

(58) Field of Classification Search
CPC ..... F25B 7/00; F25B 47/025; F25B 13/00; F25B 30/02; F25B 2347/021; F25B 2339/047; F25B 2400/06
See application file for complete search history.

(56) References Cited

U.S. PATENT DOCUMENTS 5,335,508 A 8/1994 Tippmann
5,462,113 A * 10/1995 Wand ..... F28D 9/0093 165/140
(Continued)

FOREIGN PATENT DOCUMENTS

CN 101210748 A 7/2008
JP 11-294881 A 9/1999
(Continued)

OTHER PUBLICATIONS

Notification of Transmittal of Translation of the International Preliminary Report on Patentability (Chapter I or Chapter II), including International Preliminary Report on Patentability, mailed Mar. 6, 2014 by the International Bureau of WIPO in connection with PCT International Application No. PCT/JP2012/071167, filed Aug. 22, 2012 [including English language translation].
(Continued)

*Primary Examiner* — Marc Norman
*Assistant Examiner* — Ana Vazquez
(74) *Attorney, Agent, or Firm* — John P. White; Gary J. Gershik; Cooper & Dunham LLP

(57) ABSTRACT

According to one embodiment, an apparatus includes a housing, two high-temperature-side refrigeration circuits and two low-temperature-side refrigeration circuits. Each of the high-temperature-side refrigeration circuits is configured to exchange heat with both of the two low-temperature-side refrigeration circuits by cascade heat exchangers. A hot-water pipe letting water or hot water through water-refrigerant heat exchangers of the high-temperature-side refrigeration circuits is provided. When the low-temperature-side refrigeration circuit conducts a defrosting operation of the evaporator, the low-temperature-side refrigeration circuits are controlled in such a way that the low-temperature-side refrigerant circuit releases heat in the cascade heat exchanger.

3 Claims, 7 Drawing Sheets

(51) Int. Cl.
*F25B 13/00* (2006.01)
*F25B 47/02* (2006.01)

(56) References Cited

U.S. PATENT DOCUMENTS

| | | | | |
|---|---|---|---|---|
| 6,393,858 | B1 * | 5/2002 | Mezaki | F24F 3/065 62/278 |
| 2010/0121495 | A1 | 5/2010 | Okoren et al. | |

FOREIGN PATENT DOCUMENTS

| | | | |
|---|---|---|---|
| JP | 2007-198693 | A | 8/2007 |
| KR | 2003-0071607 | A | 9/2003 |
| WO | WO 2010/098607 | A2 | 9/2010 |
| WO | WO 20111080802 | A1 | 7/2011 |

OTHER PUBLICATIONS

Microfilm of the specification and drawings annexed to the request of Japanese Utility Model Application No. 114305/1983 (Laid-open No. 23669/1985), Feb. 18, 1985, Hitachi, Ltd.

International Search Report mailed by the International Searching Authority (ISA/JP) on Oct. 2, 2012 in connection with PCT International Application No. PCT/JP2012/071167, filed Aug. 22, 2012 [including English language translation.]

Written Opinion of the International Searching Authority mailed by the International Searching Authority (ISA/JP) on Oct. 2, 2012 in connection with PCT International Application No. PCT/JP2012/071167, filed Aug. 22, 2012.

Notification for Filing Opinion, mailed Jul. 9, 2015 in connection with Korean Patent Application No. KR 10-2013-7033630, filed Dec. 18, 2013.

* cited by examiner

COMBINED CASCADE REFRIGERATION CYCLE APPARATUS

CROSS REFERENCE TO RELATED APPLICATIONS

This application is a Continuation Application of PCT Application No. PCT/JP2012/071167, filed Aug. 22, 2012 and based upon and claiming the benefit of priority from Japanese Patent Application No. 2011-180275, filed Aug. 22, 2011, the entire contents of all of which are incorporated herein by reference.

FIELD

Embodiments described herein relate generally to a combined cascade refrigeration cycle apparatus comprising two high-temperature-side refrigeration circuits and two low-temperature-side refrigeration circuits. The two high-temperature-side refrigeration circuits and the two low-temperature-side refrigeration circuits are mounted on the same housing.

BACKGROUND

A cascade refrigeration cycle apparatus comprises a housing. The housing comprises a high-temperature-side refrigeration circuit communicating with a high-temperature-side compressor, a four-way switching valve, a refrigerant-side flow channel of a water-refrigerant heat exchanger, a high-temperature-side inflation device and a high-temperature refrigerant flow channel of a cascade heat exchanger via a refrigerant pipe, and a low-temperature-side refrigeration circuit communicating with a low-temperature-side compressor, a four-way switching valve, a low-temperature refrigerant flow channel of a cascade heat exchanger, a low-temperature-side inflation device and an air heat exchanger via the refrigerant pipe. A hot-water pipe comprising a pump is connected to a water-side flow channel of the water-refrigerant heat exchanger.

A refrigerant discharged from the low-temperature-side compressor of the low-temperature-side refrigeration circuit is guided to the low-temperature refrigerant flow channel of the cascade heat exchanger, and generates condensation heat. This condensation heat is absorbed in the high-temperature refrigerant flow channel of the cascade heat exchanger in the high-temperature-side refrigeration circuit. Heat is released in the refrigerant-side flow channel of the water-refrigerant heat exchanger. Water or hot water inside the hot-water pipe connected to the water-side flow channel of the water-refrigerant heat exchanger is heated.

Jpn. Pat. Appln. KOKAI Publication No. 2007-198693 describes a cascade refrigeration cycle apparatus.

Recently, in order to more efficiently conduct a warming operation, people attempt to produce a combined cascade refrigeration cycle apparatus in which two cascade refrigeration cycle apparatuses are connected to a hot-water pipe in series or in parallel.

In this combined cascade refrigeration cycle apparatus, an air heat exchanger is used as an evaporator in a low-temperature-side refrigeration circuit. The refrigerant guided to the air heat exchanger evaporates through heat exchange with external air. Therefore, when the temperature of external air becomes extremely low, the fluid contained in external air freezes, turns to frost, and is attached as it is.

Naturally, a defrosting operation is required. As a defrosting system, there is a reverse cycle defrosting system which switches each four-way switching valve of a high-temperature-side refrigeration circuit and a low-temperature-side refrigeration circuit. Apart from this, a hot-gas defrosting system which bypasses the discharged refrigerant of a compressor of a low-temperature-side refrigeration circuit trough a cascade heat exchanger and guides the refrigerant to an evaporator can be considered.

The former system has the advantage of completing a defrosting operation in a short time since hot water of a user side is a heat source. However, there is the problem of decreasing the temperature of hot water outlet to the temperatures lower than the temperature of inlet. This problem is not caused in the latter system. However, since the latter system lacks a heat source required for a defrosting operation, defrosting time increases. As a result, the time in which hot water cannot be warmed up increases.

In these circumstances, there is demand for a combined cascade refrigeration cycle apparatus comprising the following structures: although two cascade refrigeration cycles are provided, the structures of the apparatus are simplified and a defrosting operation can be completed in a short time while decreasing the temperature of water or hot water flowing though a hot-water pipe as little as possible.

DETAILED DESCRIPTION

In general, according to one embodiment, a combined cascade refrigeration cycle apparatus includes a housing, two high-temperature-side refrigeration circuits and two low-temperature-side refrigeration circuits. Each of the high-temperature-side refrigeration circuits is configured to exchange heat with both of the two low-temperature-side refrigeration circuits by cascade heat exchangers. A hot-water pipe letting water or hot water through water-refrigerant heat exchangers of the high-temperature-side refrigeration circuits is provided. When the low-temperature-side refrigeration circuit conducts a defrosting operation of the evaporator, the low-temperature-side refrigeration circuits are controlled in such a way that the low-temperature-side refrigerant circuit releases heat in the cascade heat exchanger.

Figure 1:
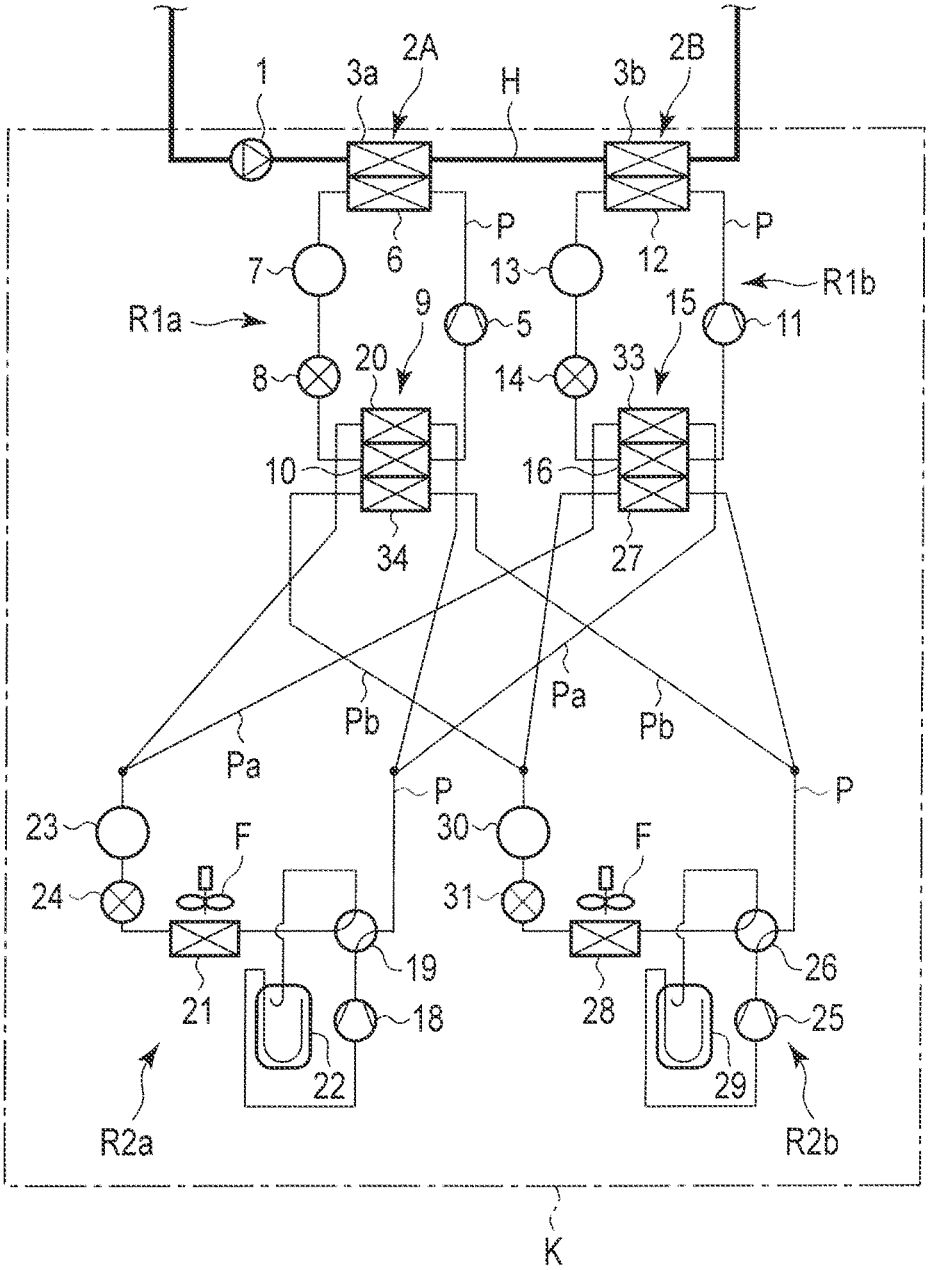
FIG. 1 is a structure diagram of a refrigeration cycle of a combined cascade refrigeration cycle apparatus according to a first embodiment.

FIG. 1 is a structure diagram of a refrigeration cycle of a combined cascade refrigeration cycle apparatus used as, for example, a hot-water supply system in a first embodiment.

The combined cascade refrigeration cycle apparatus is composed of a hot-water pipe H through which a heat medium, specifically, water or hot water passes, a first high-temperature-side refrigeration circuit R1*a*, a second high-temperature-side refrigeration circuit R1*b*, a first low-temperature-side refrigeration circuit R2*a*, a second low-temperature-side refrigeration circuit R2*b*, and a controller which is not shown in the figure. These components are mounted within a housing K.

An end of the hot-water pipe H is connected to the absorption portion of a water supply source, a hot-water storage tank or a condensate-side (return-side) buffer tank. The other end is connected to a product hot-water tapping side of a hot-water storage tank, a hot-water tap or a water-going-side (use-side) buffer tank, etc.

Within the housing K, a pump 1 is connected to the hot-water pipe H. Further, on the downstream side of the pump 1, a water-side flow channel 3*a* of a first water-refrigerant heat exchanger 2A in the first high-temperature-side refrigeration circuit R1*a*, and a water-side flow channel 3*b* of a second water-refrigerant heat exchanger 2B in the second high-temperature-side refrigeration circuit R1*b* are connected to the hot-water pipe H at predetermined intervals.

In the first high-temperature-side refrigeration circuit R1*a*, the discharge portion of a high-temperature-side compressor 5, a refrigerant-side flow channel 6 in the first water-refrigerant heat exchanger 2A, a high-temperature-side receiver 7, a high-temperature-side inflation device 8, a high-temperature-refrigerant flow channel 10 of a first cascade heat exchanger 9, and the absorption portion of the high-temperature-side compressor 5 are connected in this order via a refrigerant pipe P.

In the second high-temperature-side refrigeration circuit R1*b*, the discharge portion of a high-temperature-side compressor 11, a refrigerant-side flow channel 12 in the second water-refrigerant heat exchanger 2B, a high-temperature-side receiver 13, a high-temperature-side inflation device 14, a high-temperature refrigerant flow channel 16 of a second cascade heat exchanger 15, and the absorption portion of the high-temperature-side compressor 11 are connected in this order via a refrigerant pipe P.

In the first low-temperature-side refrigeration circuit R2*a*, the discharge portion of a low-temperature-side compressor 18 is connected to the first port of a four-way switching valve 19 via a refrigerant pipe P. The second port of the four-way switching valve 19 is connected to a first low-temperature refrigerant flow channel 20 in the first cascade heat exchanger 9 via a refrigerant pipe P. The third port of the four-way switching valve 19 is connected to a first air heat exchanger 21 which is the first evaporator via a refrigerant pipe P.

The fourth port of the four-way switching valve 19 is connected to an accumulator 22 and the absorption portion of the low-temperature-side compressor 18 in series via a refrigerant pipe P.

On the other hand, the first low-temperature refrigerant flow channel 20 in the first cascade heat exchanger 9 is connected to the air heat exchanger 21 via a refrigerant pipe P comprising a low-temperature-side receiver 23 and a low-temperature-side inflation device 24 in series. A blast fan F is provided, facing the air heat exchanger 21.

In the second low-temperature-side refrigeration circuit R2*b*, the discharge portion of a low-temperature-side compressor 25 is connected to the first port of a four-way switching valve 26 via a refrigerant pipe P. The second port of the four-way switching valve 26 is connected to a second low-temperature refrigerant flow channel 27 in the second cascade heat exchanger 15 via a refrigerant pipe P. The third port of the four-way switching valve 26 is connected to a second air heat exchanger 28 which is the second evaporator via a refrigerant pipe P.

The fourth port of the four-way switching valve 26 is connected to an accumulator 29 and the absorption portion of the low-temperature-side compressor 25 in series via a refrigerant pipe P.

On the other hand, the second low-temperature refrigerant flow channel 27 in the second cascade heat exchanger 15 is connected to the air heat exchanger 28 via a refrigerant pipe P comprising a low-temperature-side receiver 30 and a low-temperature-side inflation device 31 in series. A blast fan F is provided, facing the air heat exchanger 28.

By the structure comprising the first cascade heat exchanger 9 and the second cascade heat exchanger 15, in the first low-temperature-side refrigeration circuit R2*a*, a branching refrigerant pipe Pa diverging from each of the refrigerant pipe P connecting the four-way switching valve 19 with the first low-temperature refrigerant flow channel 20 in the first cascade heat exchanger 9 and the refrigerant pipe P connecting the first low-temperature refrigerant flow channel 20 with the low-temperature-side receiver 23 is connected to a first low-temperature refrigerant flow channel 33 in the second cascade heat exchanger 15.

A branching refrigerant pipe Pb diverging from each of the refrigerant pipe P connecting the four-way switching valve 26 in the second low-temperature-side refrigeration circuit R2*b* with the second low-temperature refrigerant flow channel 27 in the second cascade heat exchanger 15 and the refrigerant pipe P connecting the second low-temperature refrigerant flow channel 27 with the low-temperature-side receiver 30 is connected to a second low-temperature refrigerant flow channel 34 in the first cascade heat exchanger 9.

The cascade refrigeration cycle apparatus is structured as described above. The controller which received an instruction for starting a refrigeration cycle operation (heating operation mode) conducts control as explained later. The controller guides a refrigerant to the first high-temperature-side refrigeration circuit R1*a*, the second high-temperature-side refrigeration circuit R1*b*, the first low-temperature-side refrigeration circuit R2*a* and the second low-temperature-side refrigeration circuit Rb2 to circulate the refrigerant.

In the first high-temperature-side refrigeration circuit R1*a*, a refrigerant is guided to the high-temperature-side compressor 5, the refrigerant-side flow channel 6 in the first water-refrigerant heat exchanger 2A, the high-temperature-side receiver 7, the high-temperature-side inflation device 8, the high-temperature refrigeration flow channel 10 in the first cascade heat exchange 9, and the high-temperature-side compressor 5 in this order, and circulates through the circuit.

The refrigerant-side flow channel 6 in the first water-refrigerant heat exchanger 2A functions as a condenser. The high-temperature refrigerant flow channel 10 in the first cascade heat exchanger 9 functions as an evaporator.

In the first low-temperature-side refrigeration circuit R2*a*, a refrigerant discharged from the low-temperature-side compressor 18 is guided to the four-way switching valve 19, the first low-temperature refrigerant flow channel 20 in the first cascade heat exchanger 9, the low-temperature-side receiver 23, the low-temperature-side inflation device 24, the first air heat exchanger 21, the four-way switching valve 19, the accumulator 22 and the low-temperature-side compressor 18 in this order, and circulates through the circuit.

In the second high-temperature-side refrigeration circuit R1*b*, a refrigerant is guided to the high-temperature-side compressor 11, the refrigerant-side flow channel 12 in the second water-refrigerant heat exchanger 2B, the high-temperature-side receiver 13, the high-temperature-side inflation device 14, the high-temperature refrigerant flow channel 16 in the second cascade heat exchanger 15, and the high-temperature-side compressor 11 in this order, and circulates through the circuit.

The refrigerant-side flow channel 12 in the second water-refrigerant heat exchanger 2B functions as a condenser. The high-temperature refrigerant flow channel 16 in the second cascade heat exchanger 15 functions as an evaporator.

In the second low-temperature-side refrigeration circuit R2*b*, a refrigerant discharged from the low-temperature-side compressor 25 is guided to the four-way switching valve 26, the second low-temperature refrigerant flow channel 27 in the second cascade heat exchanger 15, the low-temperature-side receiver 30, the low-temperature-side inflation device 31, the second air heat exchanger 28, the four-way switching valve 26, the accumulator 29 and the low-temperature-side compressor 25 in this order, and circulates through the circuit.

Furthermore, in the first low-temperature-side refrigeration circuit R2*a*, a refrigerant is guided to the branching refrigerant pipe Pa diverging ahead of the four-way switching valve 19, and circulates through the first low-temperature refrigerant flow channel 33 in the second cascade heat exchanger 15 in the second low-temperature-side refrigeration circuit R2*b*.

In the second low-temperature-side refrigeration circuit R2*b*, a refrigerant is guided to the branching refrigerant pipe Pb diverging ahead of the four-way switching valve 26, and circulates through the second low-temperature refrigerant flow channel 34 in the first cascade heat exchanger 9 in the first low-temperature-side refrigeration circuit R2*a*.

In the first cascade heat exchanger 9, the first low-temperature refrigerant flow channel 20 and the second low-temperature refrigerant flow channel 34 function as condensers, and as described above, the high-temperature refrigerant flow channel 10 in the first high-temperature-side refrigeration circuit R1*a* functions as an evaporator. Thus, a refrigerant is condensed in the first and second low-temperature refrigerant flow channels 20 and 34, and releases condensation heat. The refrigerant evaporates, absorbing this condensation heat in the high-temperature refrigerant flow channel 10.

The water guided to the hot-water pipe H via the pump 1 absorbs condensation heat whose temperature is high from the refrigerant-side flow channel 6 of the first water-refrigerant heat exchanger 2A in the water-side flow channel 3*a* of the first water-refrigerant heat exchanger 2A. The refrigerant-side flow channel 6 has a condensation function in the first high-temperature-side refrigeration circuit R1*a*. Thus, the temperature of the water rises up to a high level. The hot water whose temperature became high in the water-side flow channel 3*a* of the first water-refrigerant heat exchanger 2A is guided to the water-side flow channel 3*b* of the second water-refrigerant heat exchanger 2B.

In the second cascade heat exchanger 15, the first low-temperature refrigerant flow channel 33 and the second low-temperature refrigerant flow channel 27 function as condensers, and as described above, the high-temperature refrigerant flow channel 16 of the second high-temperature-side refrigeration circuit R1*b* functions as an evaporator. Thus, in the first and second low-temperature refrigerant flow channels 33 and 27, a refrigerant is condensed and releases condensation heat. The refrigerant evaporates, absorbing this condensation heat in the high-temperature refrigerant flow channel 16.

The hot water guided to the water-side flow channel 3*b* of the second water-refrigerant heat exchanger 2B from the first water-refrigerant heat exchanger 2A absorbs condensation heat whose temperature is high from the refrigerant-side flow channel 12 of the first water-refrigerant heat exchanger 2B. The refrigerant-side flow channel 12 has a condensation function in the second high-temperature-side refrigeration circuit R1*b*. Thus, the temperature of the water becomes high. The temperature of the water increases to a preset temperature in the water-side flow channel 3*b* of the second water-refrigerant heat exchanger 2B.

The hot water which came out from the second water-refrigerant heat exchanger 2B and has a temperature increased to a preset temperature is guided to the product hot-water tapping side of a hot-water storage tank, a hot-water tap or a water-going-side buffer tank, etc. Further, the hot water is guided to the first and second water-refrigerant heat exchangers 2A and 2B again, is heated, and circulates through the hot-water storage tank or the water-going-side buffer tank. Alternatively, the hot water is directly supplied to the hot-water tap.

When the external temperature is very low, frost is attached to the first and second air heat exchangers 21 and 28 which are evaporators of the first low-temperature-side refrigeration circuit R2*a* and the second low-temperature-side refrigeration circuit R2*b*. Thus, heat exchange efficiency is reduced. Therefore, a defrost operation is conducted for the first and second air heat exchangers 21 and 28.

The first air heat exchanger 21 is not defrosted at the same time as the second air heat exchanger 28. For example, the first air heat exchanger 21 in the first low-temperature-side refrigeration circuit R2*a* is defrosted, and after the completion of the defrost operation, the second air heat exchanger 28 in the second low-temperature-side refrigeration circuit R2*b* is defrosted.

Reversely, after the completion of the defrost operation of the second air heat exchanger 28, the first air heat exchanger 21 may be defrosted.

When the first air heat exchanger 21 in the first low-temperature-side refrigeration circuit R2*a* is firstly defrosted, the four-way switching valve 19 of the first low-temperature-side refrigeration circuit R2*a* is switched to the reverse cycle. The four-way switching valve 26 of the second low-temperature-side refrigeration circuit R2*b* may be maintained at the heating operation.

The compressor 5 of the first high-temperature-side refrigeration circuit R1*a*, and the compressor 11 of the second high-temperature-side refrigeration circuit Rib are stopped, or operated at a very low speed. The compressor 25 of the second low-temperature-side refrigeration circuit R2*b* during heating operation increases the operation frequency to enhance thermal capability.

Since hot water is not heated at this state, the pump 1 is stopped. However, if hot water needs to be continuously circulated because of the request from a user, etc., the operation of the pump 1 may be continued.

In the first low-temperature-side refrigeration circuit R2*a*, a refrigerant which is discharged from the low-temperature-side compressor 18 and has high temperature and high pressure is directly guided to the first air heat exchanger 21 via the four-way switching valve 19, and is condensed. The refrigerant releases condensation heat, and melts the attached frost.

A refrigerant evaporates in the first low-temperature refrigerant flow channel 20 in the first cascade heat exchanger 9, and the first low-temperature refrigerant flow channel 33 in the second cascade heat exchanger 15. Since the second low-temperature-side refrigerant circuit R2*b* keeps its heating operation, the amount of heat equivalent to the evaporation heat is continuously supplied as condensation heat to the second low-temperature refrigerant flow channel 34 in the first cascade heat exchanger 9, and the second low-temperature refrigerant flow channel 27 in the second cascade heat exchanger 15.

In the case where the compressor 5 of the first high-temperature-side refrigeration circuit R1*a*, and the compressor 11 of the second high-temperature-side refrigeration circuit R1*b* are stopped during a defrost operation, although the first low-temperature refrigerant flow channel 20 and the second low-temperature refrigerant flow channel 34 in the first cascade heat exchanger 9 are not adjacent, projection portions formed in the metal plate of the heat exchanger make contact with each other. Therefore, heat can be transferred by thermal conduction of the metal plate.

The above explanation is also applied to the first low-temperature refrigerant flow channel 33 and the second low-temperature refrigerant flow channel 27 in the second cascade heat exchanger 15.

In the case where the compressor 5 of the first high-temperature-side refrigeration circuit R1*a* and the compressor 11 of the second high-temperature-side refrigeration circuit R1*b* are operated at a very low speed by a heating operation during defrosting, flow is caused in the first high-temperature refrigerant flow channel 10 between the first low-temperature refrigerant flow channel 20 and the second low-temperature refrigerant flow channel 34 in the first cascade heat exchanger 9, and the second high-temperature refrigerant flow channel 16 between the first low-temperature refrigerant flow channel 33 and the second low-temperature refrigerant flow channel 27 in the second cascade heat exchanger 15. Therefore, it is possible to transfer heat in association with the change of phase of a refrigerant within the high-temperature refrigerant flow channels 10 and 16.

In the first cascade heat exchanger 9 and the second cascade heat exchanger 15, the first low-temperature refrigerant flow channels 20 and 33 in the first low-temperature-side refrigeration circuit R2*a* during defrosting absorb heat from the second low-temperature refrigerant flow channels 34 and 27 in the second low-temperature-side refrigeration circuit R2*b* during a heating operation, and construct a binary cycle during defrosting.

Thus, a supply source of heat is ensured. Therefore, a defrosting operation can be completed in a short time. Since hot water is not a heat source, the extreme decrease in temperature of hot water can be prevented in the hot-water pipe H during defrosting.

It is possible to prevent the outflow of hot water which is not heated because the pump 1 can be stopped. However, in the case where hot water needs to be continuously circulated because of the request from a user, etc., the pump 1 may be continuously operated.

After the defrosting of the first air heat exchanger 21 is finished, the defrosting of the second air heat exchanger 28 is begun. Specifically, the four-way switching valve 19 of the first low-temperature-side refrigeration circuit R2*a* is switched to a normal heating operation, and the four-way switching valve 26 of the second low-temperature-side refrigeration circuit R2*b* is switched to a reverse cycle.

Further, the compressors 5, 11, 18 and 25 of the refrigeration circuits R1*a*, R1*b*, R2*b* and R2*a* are driven as described above.

In the second low-temperature-side refrigeration circuit R2*b*, a refrigerant which is discharged from the low-temperature-side compressor 25 and has high temperature and high pressure is directly guided to the second air heat exchanger 28 via the four-way switching valve 26, and is condensed. The refrigerant releases condensation heat and melts the attached frost.

A refrigerant evaporates in the second low-temperature refrigerant flow channel 34 in the first cascade heat exchanger 9, and the second low-temperature refrigerant flow channel 27 in the second cascade heat exchanger 15. Since the first low-temperature-side refrigeration circuit R2*a* conducts a heating operation, the amount of heat equivalent to the evaporation heat is continuously supplied as condensation heat to the first low-temperature refrigerant flow channel 20 in the first cascade heat exchanger 9, and the first low-temperature refrigerant flow channel 33 in the second cascade heat exchanger 15.

The explanations of the embodiments of heat transfer in the case where the compressor 5 of the first high-temperature-side refrigeration circuit R1*a* and the compressor 11 of the second high-temperature-side refrigeration circuit R1*b* are stopped during defrosting and in the case where the compressors are operated at a very low speed by a heating operation are omitted here since the embodiments are the same as those explained above.

Thus, in the first cascade heat exchanger 9 and the second cascade heat exchanger 15, the second low-temperature refrigerant flow channels 34 and 27 in the second low-temperature-side refrigeration circuit R2*b* during defrosting absorb heat from the first low-temperature refrigerant flow channels 20 and 33 in the first low-temperature-side refrigeration circuit R2*a* during a heating operation, and construct a binary cycle during defrosting.

Since the supply source of heat is assured, a defrosting operation can be completed in a short time. Because hot water is not a heat source, the extreme reduction in temperature of hot water can be prevented in the hot-water pipe H during defrosting. As the pump 1 can be stopped, the outflow of unheated hot water can be prevented. However, in the case where hot water needs to be continuously circulated because of the request from a user, etc., the operation of the pump 1 may be continued.

After the defrosting operation of the second air heat exchanger 28 is completed in this manner, the four-way switching valve 26 is switched to a normal heating operation in the second low-temperature-side refrigeration circuit R2*b*. If the compressor 5 of the first high-temperature-side refrigeration circuit R1*a*, the compressor 11 of the second high-temperature-side refrigeration circuit R1*b* and the pump 1 are stopped, the pump 1 may be driven.

Therefore, a four-way switching valve and an accumulator may be unneeded in the first and second high-temperature-side refrigeration circuits R1*a* and R1*b*. Thus, the structure can be simplified.

Since a supply source of heat can be assured when frost is removed, a defrosting operation can be completed in a short time. The temperature of the compressor is not decreased more than necessary. Therefore, the performance is started up in a short time at the time of recovery of a heating operation after a defrosting operation. Moreover, since hot water is not a heat source, the pump can be stopped when frost is eliminated, and thus, the outflow of hot water below the preset temperature can be prevented.

Figure 2:
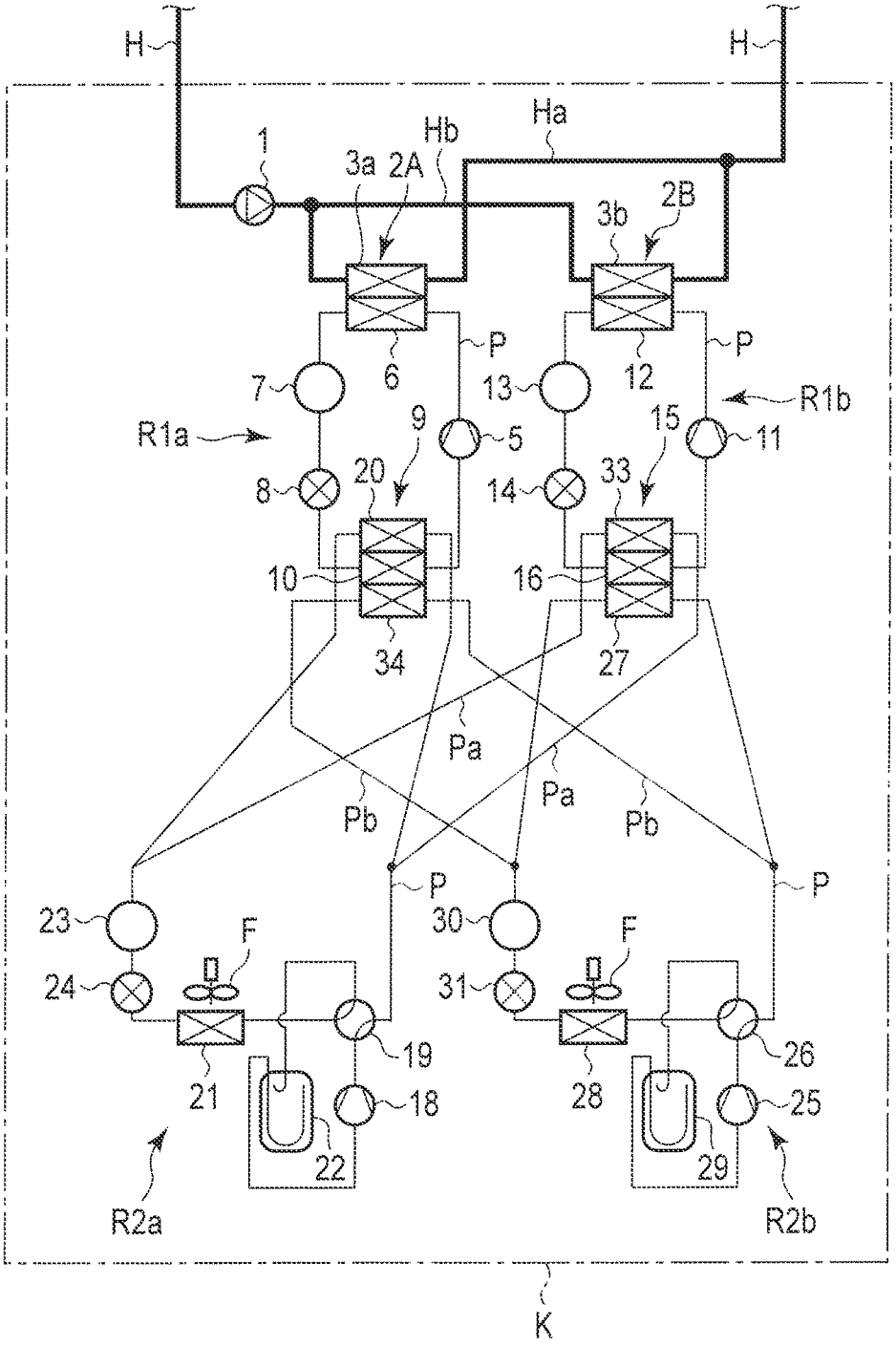
FIG. 2 is a structure diagram of a refrigeration cycle of a combined cascade refrigeration cycle apparatus according to a second embodiment.

FIG. 2 is a structure diagram of a refrigeration cycle of a combined cascade refrigeration cycle apparatus according to a second embodiment.

Here, the structure of a hot-water pipe H is different from the combined cascade refrigeration cycle apparatus of the first embodiment. The other structural components are the same as the combined cascade refrigeration cycle apparatus of the first embodiment. These components are denoted by the same reference numbers, and the explanations of the same components are omitted.

An end of the hot-water pipe H is connected to the absorption portion of a water supply source, a hot-water storage tank or a condensate-side (return-side) buffer tank. The hot-water pipe H extends to the inside of a housing K. Here, the pump 1 is connected. Ahead of the pump 1, the hot-water pipe H diverges into two branching hot-water pipes Ha and Hb.

To the branching hot-water pipe Ha which is one of the two branching hot-water pipes, a water-side flow channel 3*a* of a first water-refrigerant heat exchanger 2A is connected. To the other branching hot-water pipe Hb, a water-side flow channel 3*b* of a second water-refrigerant heat exchanger 2B is connected.

A refrigerant-side flow channel 6 is integrally provided in the water-side flow channel 3*a* of the first water-refrigerant heat exchanger 2A in such a way that heat can be exchanged. In the water-side flow channel 3*b* of the second water-refrigerant heat exchanger 2B, a refrigerant-side flow channel 12 is integrally provided in such a way that heat can be exchanged.

The branching hot-water pipes Ha and Hb are connected to the water-side flow channels 3*a* and 3*b* of the first and second water-refrigerant heat exchangers 2A and 2*b* respectively. After that, the branching hot-water pipes Ha and Hb are united as one hot-water pipe H, and connected to the product hot-water tapping side of a hot-water storage tank, a hot-water tap or a water-going-side (use-side) buffer tank, etc.

Ahead of the refrigerant-side flow channel 6 of the first water-refrigerant heat exchanger 2A, a first low-temperature-side refrigeration circuit R2*a* and a second low-temperature-side refrigeration circuit R2*b* are connected via the aforementioned first high-temperature-side refrigeration circuit R1*a*. Ahead of the refrigerant-side flow channel 12 of the second water-refrigerant heat exchanger 2B, the first low-temperature-side refrigeration circuit R2*a* and the second low-temperature-side refrigeration circuit R2*b* are connected via the aforementioned second high-temperature-side refrigeration circuit R1*b*.

Therefore, the above heating operation and defrosting operation are conducted.

Figure 3:
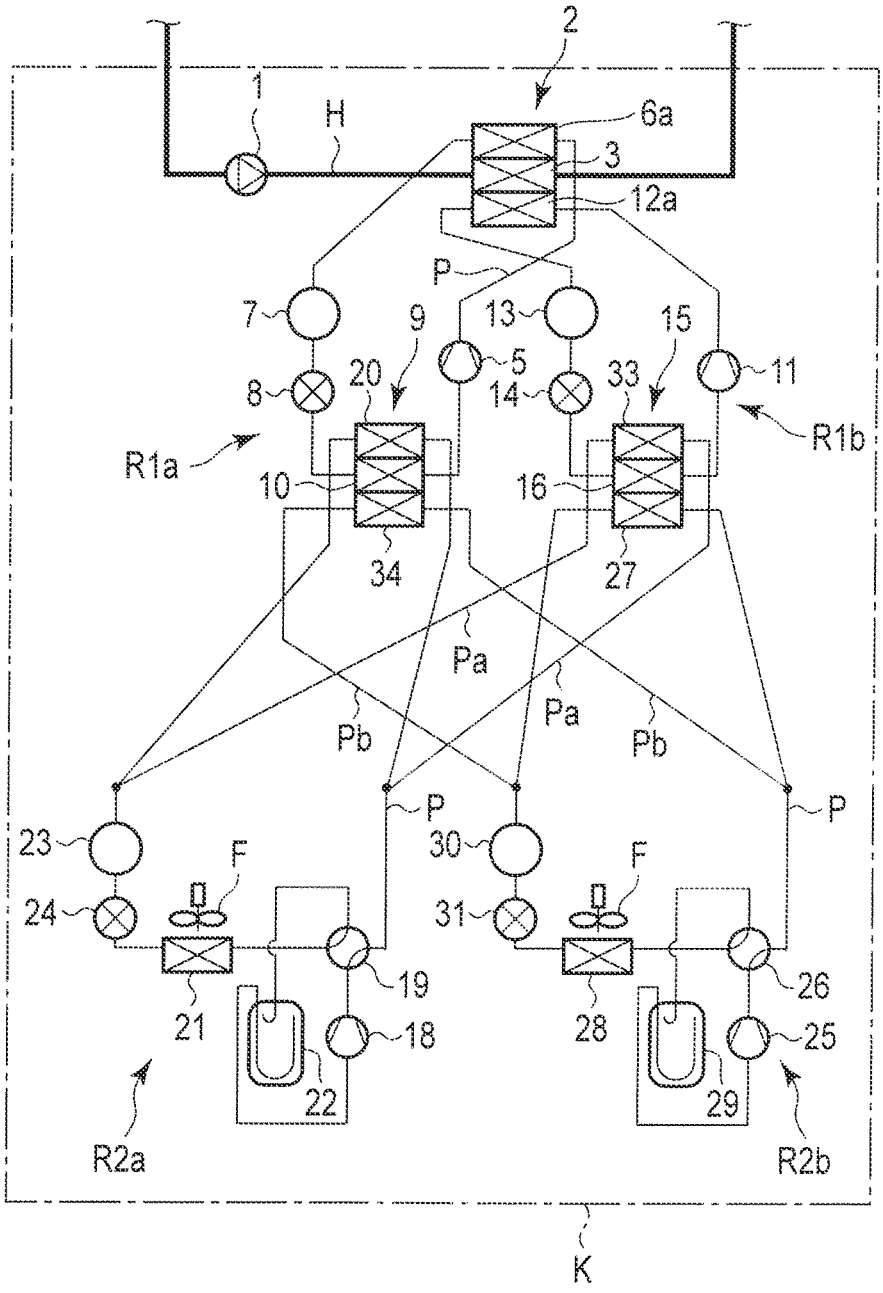
FIG. 3 is a structure diagram of a refrigeration cycle of a combined cascade refrigeration cycle apparatus according to a third embodiment.

FIG. 3 is a structure diagram of a refrigeration cycle of a combined cascade refrigeration cycle apparatus according to a third embodiment. The combined cascade refrigeration cycle apparatus of the third embodiment is structured by integrally forming water-refrigerant exchangers of two high-temperature-side refrigeration circuits.

Here, the structure of a water-refrigerant heat exchanger 2 connected to a hot-water pipe H is different from the combined cascade refrigeration cycle apparatuses of the first and second embodiments. The other structural components are the same as the combined cascade refrigeration cycle apparatuses of the first and second embodiments. The explanations of the same structural components are omitted by adding the same reference numbers to these components.

The first water-refrigerant heat exchanger 2A and the second water-refrigerant heat exchanger B in the first and second embodiments correspond to the first high-temperature-side refrigeration circuit R1*a* and the second high-temperature-side refrigeration circuit R2*b* respectively.

On the other hand, in the water-refrigerant heat exchanger 2 of the third embodiment, a refrigerant-side flow channel 6*a* of a first high-pressure-side refrigeration circuit R1*a* is located on a surface side of a water-side flow channel 3 connected to the hot-water pipe H. On another surface side, a refrigerant-side flow channel 12*a* of a second high-pressure-side refrigeration circuit R1*b* is located.

Thus, it is possible to flow three fluids into one water-refrigerant heat exchanger 2. In this manner, the structure can be simplified.

When the requesting ability is deteriorated due to the increase in external temperature and reduction in heating load, a heating ability is reduced by decreasing the operation frequency of high-temperature-side compressors 5 and 11 of the first and second high-temperature-side refrigeration circuits R1*a* and R1*b*, and low-temperature-side compressors 18 and 25 of first and second low-temperature-side refrigeration circuits R2*a* and R2*b*.

However, it is difficult to decrease the frequency of each of the compressors 5, 11, 18 and 25 to the lower limit or less. If the heating performance needs to be further reduced, one of the low-temperature-side compressors 18 and 25 of the first low-temperature-side refrigeration circuit R2*a* and the second low-temperature-side refrigeration circuit R2*b* is stopped.

In this regard, saturation evaporation temperature and saturation condensation temperature of a refrigerant inside cascade heat exchangers 9 and 15 in the first and second high-temperature-side refrigeration circuits R1*a* and R1*b* are decreased at the same time. The refrigerant density of absorption of the compressors 5 and 11 in the first and second high-temperature-side refrigeration circuits R1*a* and R1*b* is also decreased.

In this manner, the refrigerant circulation amount of the first and second high-temperature-side refrigeration circuits is reduced, and further reduction of the heating performance is possible. Thus, it is possible to reduce the minimum capacity at the time of low loading.

Figure 4:
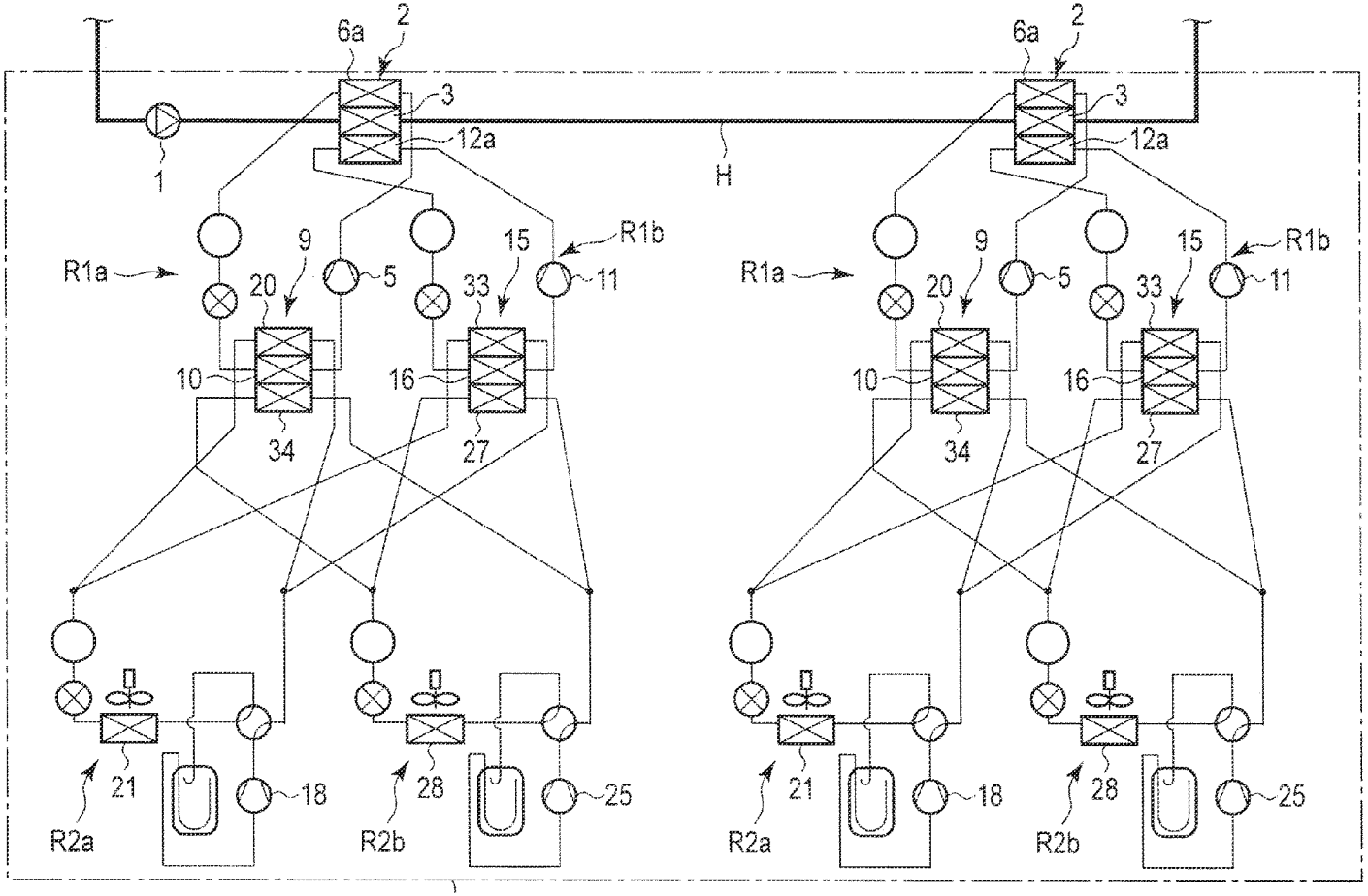
FIG. 4 is structure diagram of a refrigeration cycle of a combined cascade refrigeration cycle apparatus according to a fourth embodiment.

FIG. 4 is a structure diagram of a refrigeration cycle of a combined cascade refrigeration cycle apparatus according to a fourth embodiment.

Specifically, the combined cascade refrigeration cycle apparatus of FIG. 4 is composed by connecting two combined cascade refrigeration cycle apparatuses shown in FIG. 3 in series with respect to a hot-water pipe H. Two water-refrigerant heat exchangers 2 are provided at a predetermined interval. In each of the water-refrigerant heat exchangers 2, a refrigerant-side flow channel 6*a* of a first high-temperature-side refrigeration circuit R1*a* is located on a surface side of a water-side flow channel 3 connected to the hot-water pipe H. On another surface, a refrigerant-side flow channel 12*a* of a second high-temperature-side refrigeration circuit R1*b* is located.

To the first high-temperature-side refrigeration circuit R1*a*, a high-temperature refrigerant flow channel 10 in a first cascade heat exchanger 9 is connected. On one surface of the high-temperature refrigerant flow channel 10, a first low-temperature refrigerant flow channel 20 in a first low-temperature-side refrigeration circuit R2*a* is provided. On another surface, a second low-temperature refrigerant flow channel 34 in a second low-temperature-side refrigeration circuit R2*b* is provided. This structure is unchanged.

Similarly, a high-temperature refrigerant flow channel 16 in a second cascade heat exchanger 15 is connected to a second high-temperature-side refrigeration circuit R1*b*. On a surface of the high-temperature refrigerant flow channel 16, a first low-temperature refrigerant flow channel 33 in the first low-temperature-side refrigeration circuit R2*a* is provided. On another surface, a second low-temperature refrigerant flow channel 27 in the second low-temperature-side refrigeration circuit R2*b* is provided.

Thus, the apparatus comprises two exchangers whose structures are completely the same as each other with respect to the hot-water pipe H. By simultaneously driving each exchanger, water or hot water which is guided from the absorption portion of a water supply source, a hot-water storage tank or a condensate-side (return-side) buffer tank to the hot-water pipe H and has a flow volume equivalent to twice as much as the case of one exchanger is changed to hot water whose temperature is high. The hot water is then guided to the product hot-water tapping side of a hot-water storage tank, a hot-water tap or a water-going-side (use-side) buffer tank, etc.

In a defrosting operation, four air heat exchangers 21 and 28 of the low-temperature-side refrigeration circuits R2*a* and R2*b* are individually implemented one by one. At this time, there are two low-temperature-side refrigeration circuits which continue heating operations. These circuits can contribute to hot-water heating.

In sum, for example, during a defrosting operation of the first low-temperature-side refrigeration circuit R2*a* or the second low-temperature-side refrigeration circuit R2*b* on the side close to the discharge portion of a pump 1, the first high-temperature-side refrigeration circuit R1*a* and the second high-temperature-side refrigeration circuit Rib on the side close to the discharge portion of the pump 1 are stopped, or operated at a very low speed, and cannot contribute to hot-water heating.

However, it is possible to continuously extract the amount of heat in the hot-water pipe H by conducting a heating operation in the first and second low-temperature-side refrigeration circuits R2*a* and R2*b* on the far side from the discharge side of the pump 1, and conducting an operation in the first and second high-temperature-side refrigeration circuits R1*a* and R1*b* on the far side from the discharge side of the pump 1.

Further, during the defrosting operation of the first low-temperature-side refrigeration circuit R2*a* or the second low-temperature-side refrigeration circuit R2*b* on the far side from the discharge portion of the pump 1, the first high-temperature-side refrigeration circuit R1*a* and the second high-temperature-side refrigeration circuit R1*b* on the far side from the discharge portion of the pump 1 are stopped or operated at a very low speed, and cannot contribute to hot water heating.

However, it is possible to continuously take out the amount of heat in the hot-water pipe H by conducting a heating operation in the first and second low-temperature-side refrigeration circuits R2*a* and R2*b* on the side close to the discharge side of the pump 1, and conducting an operation in the first and second high-temperature-side refrigeration circuits R1*a* and R1*b* on the side close to the discharge side of the pump 1.

In the case where an inverter type is employed for the pump 1, it is possible to keep the outlet water temperature constant by reducing the amount of water at the time of defrosting operation.

Each of the first and second cascade heat exchangers 9 and 15 used here is a plate type heat exchanger formed in a space portion dividing three flow channels with a plurality of partitions (plates). The three flow channels are, the high-temperature refrigerant flow channel 10 or 16, the first low-temperature refrigerant flow channel 20 or 33, and the second low-temperature refrigerant flow channel 34 or 27.

Figure 5:
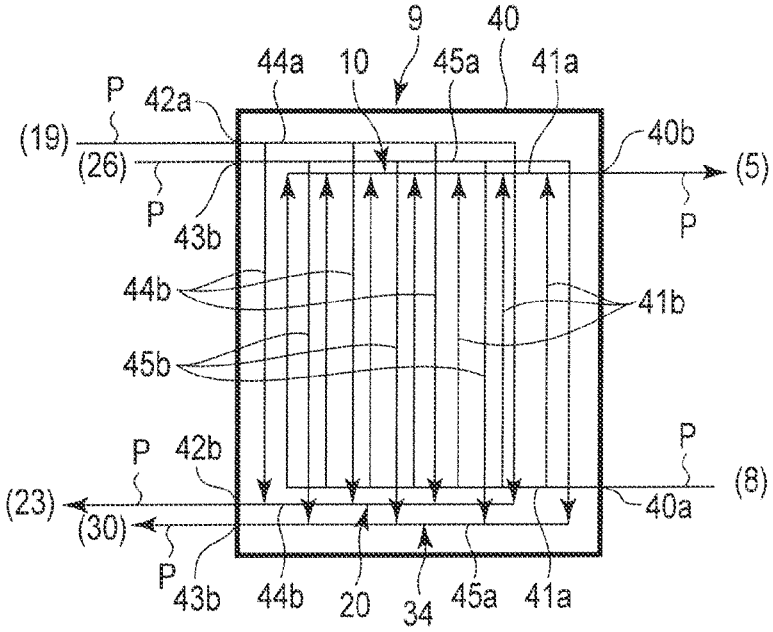
FIG. 5 is an overview structure diagram of a cascade heat exchanger used for each embodiment.

The first and second cascade heat exchangers 9 and 15 have the same structures as each other. Therefore, hereinafter, this specification employs the first cascade heat exchanger 9 and explains structures based on FIG. 5.

On a side surface of an apparatus body 40 constituting the first cascade heat exchanger 9, a high-temperature refrigerant inlet 40*a* and a high-temperature refrigerant outlet 40*b* are provided at ends apart from each other. The refrigerant pipe P communicating with the high-temperature-side inflation device 8 is connected to the high-temperature refrigerant inlet 40*a*. The refrigerant pipe P communicating with the absorption portion of the high-temperature-side compressor 5 is connected to the high-temperature refrigerant outlet 40*b*.

The high-temperature refrigerant flow channel 10 is composed within the apparatus body 40. The high-temperature refrigerant flow channel 10 is composed of main flow channels 41*a* and a plurality of high-temperature refrigerant branching flow channels 41*b*. The main flow channels 41*a* are connected to the high-temperature refrigerant inlet 40*a* and the high-temperature refrigerant outlet 40*b*, and are parallel to each other. The ends of the main flow channels 41*a* are blocked. The plurality of high-temperature refrigerant branching flow channels 41*b* communicate across the main flow channels 41*a*, and are parallel to each other at predetermined intervals.

On another side surface of the apparatus body 40, a first low-temperature refrigerant inlet 42*a* and a second low-temperature refrigerant inlet 43*a* are provided at positions adjacent to each other. At positions apart from these inlets on the same side surface of the apparatus 40, a first low-temperature refrigerant outlet 42*b* and a second low-temperature refrigerant outlet 43*b* are provided. These outlets are located at positions adjacent to each other.

The refrigerant pipe P communicating with the second port of the four-way switching valve 19 in the first low-temperature-side refrigeration circuit R2*a* is connected to the first low-temperature refrigerant inlet 42*a*. The refrigerant pipe P communicating with the low-temperature-side receiver 23 in the same refrigeration circuit R2*a* is connected to the first low-temperature refrigerant outlet 42*b*.

The refrigerant pipe P communicating with the second port of the four-way switching valve 26 in the second low-temperature-side refrigeration circuit R2*b* is connected to the second low-temperature refrigerant inlet 43*a*. The refrigerant pipe P communicating with the low-temperature-side receiver 30 in the same refrigerant circuit R2*b* is connected to the second low-temperature refrigerant outlet 43*b*.

Within the apparatus body 40, the first low-temperature refrigerant flow channel 20 communicating with the first low-temperature refrigerant inlet 42*a* and the first low-temperature refrigerant outlet 42*b* is formed. Moreover, the second low-temperature refrigerant flow channel 34 communicating with the second low-temperature refrigerant inlet 43*a* and the second low-temperature refrigerant outlet 43*b* is structured.

The first low-temperature refrigerant flow channel 20 is composed of main flow channels 44*a* and a plurality of first low-temperature refrigerant branching flow channels 44*b*. The main flow channels 44*a* are connected to the first low-temperature refrigerant inlet 42*a* and the first low-temperature refrigerant outlet 42*b*, and are parallel to each other. The ends of the main flow channels 44*a* are blocked. The plurality of first low-temperature refrigerant branching flow channels 44*b* communicate over the main flow channels 44*a*, and are parallel to each other at predetermined intervals.

The second low-temperature refrigerant flow channel 34 is composed of main flow channels 45*a* and a plurality of second low-temperature refrigerant branching flow channels 45*b*. The main flow channels 45*a* are connected to the second low-temperature refrigerant inlet 43*a* and the second low-temperature refrigerant outlet 43*b*, and are parallel to each other. The ends of the main channels 45*a* are blocked. The plurality of second low-temperature refrigerant branching flow channels 45*b* communicate over the main flow channels 45*a*, and are parallel to each other at predetermined intervals.

After all, within the apparatus body 40, the high-temperature refrigerant branching flow channels 41*b* constituting the high-temperature refrigerant flow channel 10, the first low-temperature refrigerant branching flow channels 44*b* constituting the first low-temperature refrigerant flow channel 20, and the second low-temperature refrigerant branching flow channels 45*b* constituting the second low-temperature refrigerant flow channel 34 are provided in parallel with each other at predetermined intervals.

In other words, with the high-temperature refrigerant branching flow channel 41*b* being interposed, the first low-temperature refrigerant branching flow channel 44*b* is provided on a surface side, and the second low-temperature refrigerant branching flow channel 45*b* is provided on another surface side. The first and second low-temperature refrigerant branching flow channels 44*b* and 45*b* are alternately located with respect to the high-temperature refrigerant branching flow channel 41*b*.

The first cascade heat exchanger 9 is formed in this manner. In the high-temperature-side refrigeration circuit R1*a*, the high-temperature refrigerant guided from the high-temperature refrigerant inlet 40*a* to the high-temperature refrigerant flow channel 10 is divided from one of the main channels 41*a* into the plurality of high-temperature refrigerant branching channels 41*b*, is collected in the other main channel 41*a* again, and comes out from the high-temperature refrigerant outlet 40*b*.

In the first low-temperature-side refrigeration circuit R2*a*, the low-temperature refrigerant guided from the first low-temperature refrigerant inlet 42*a* to the first low-temperature refrigerant flow channel 20 is divided from one of the main channels 44*a* into the plurality of first low-temperature refrigerant branching flow channel 44*b*, is collected in the other main channel 44*a* again, and comes out from the first low-temperature refrigerant outlet 42*b*.

The refrigerant divided from the second low-temperature-side refrigeration circuit R2*b* to the second low-temperature refrigerant inlet 43*a* is divided from one of the main channels 45*a* into the plurality of second low-temperature refrigerant branching flow channels 45*b*. The main channels 45*a* and the plurality of second low-temperature refrigerant branching flow channels 45*b* constitutes the second low-temperature refrigerant flow channel 34. The refrigerant is collected in the other main flow channel 45*a* again, and comes out from the second low-temperature refrigerant outlet 43*b*.

In sum, in the first cascade heat exchanger 9, with respect to the plurality of high-temperature refrigerant branching flow channels 41*b* which are parallel to each other, the first low-temperature refrigerant branching channels 44*b* and the second low-temperature refrigerant branching channels 45*b* are alternately provided with a partition being interposed between each of the first low-temperature refrigerant branching channels 44*b* and each of the second low-temperature refrigerant branching channels 45*b*.

A material which is excellent in thermal conductivity is used for the apparatus body 40 constituting the first cascade heat exchanger 9, and the partition dividing each flow channel. The high-temperature refrigerant, the first low-temperature refrigerant and the second low-temperature refrigerant can efficiently exchange heat by the flow channel structures of the first cascade heat exchanger 9 explained above and the selection of the structural material. Thus, the heat exchange efficiency can be improved.

Each of the high-temperature refrigerant inlet 40*a*, the high-temperature refrigerant outlet 40*b*, the first low-temperature refrigerant inlet 42*a*, the second low-temperature refrigerant inlet 43*a*, the first low-temperature refrigerant outlet 42*b* and the second low-temperature refrigerant outlet 43*b* may be provided on any side surface of the apparatus body 40, and is not limited at all.

For example, all of the high-temperature refrigerant inlet 40*a*, the high-temperature refrigerant outlet 40*b*, the first low-temperature refrigerant inlet 42*a*, the second low-temperature refrigerant inlet 43*a*, the first low-temperature refrigerant outlet 42*b* and the second low-temperature refrigerant outlet 43*b* may be provided on the same side surface of the apparatus body 40.

Figure 6:
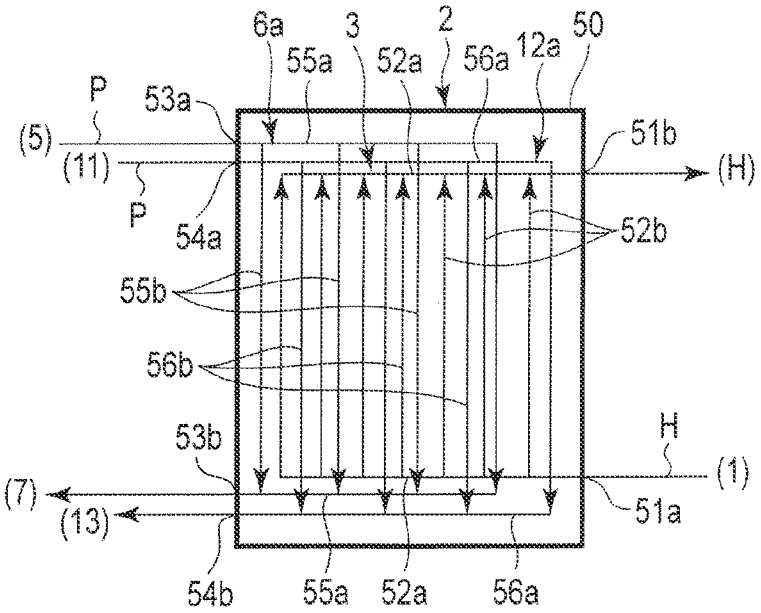
FIG. 6 is an overview structure diagram of a water-refrigerant heat exchanger used for the third and fourth embodiments.

FIG. 6 shows an overview structure of the water-refrigerant heat exchanger 2 used for the third and fourth embodiments. The water-refrigerant heat exchanger 2 is a plate type heat exchanger formed in a space portion in which three flow channels are divided by a plurality of partitions (plates). The three flow channels are the water-side flow channel 3, the first refrigerant-side flow channel 6*a* and the second refrigerant-side flow channel 12*a*.

On a side surface of an apparatus body 50 constituting the water-refrigerant heat exchanger 2, a water inlet 51*a* and a water outlet 51*b* are provided at ends which are apart from each other. The hot-water pipe H communicating with the pump 1 is connected to the water inlet 51*a*. The hot-water pipe H communicating with the product hot-water tapping side of a hot-water storage tank, a hot-water tap or a water-going-side (use-side) buffer tank, etc. is connected to the water outlet 51*b*.

Within the apparatus body 50, the water-side flow channel 3 is formed. The water-side flow channel 3 is composed of main flow channels 52*a* and a plurality of water-side branching flow channels 52*b*. The main flow channels 52*a* are connected to the water inlet 51*a* and the water outlet 51*b*, and are parallel to each other. The ends of the main flow channels 52 are blocked. The plurality of water-side branching flow channels 52*b* communicate over the main flow channels 52*a*, and are parallel to each other at predetermined intervals.

On another side surface of the apparatus body 50, a first high-temperature refrigerant inlet 53*a* and a second high-temperature refrigerant inlet 54*a* are provided at positions adjacent to each other. At positions apart from these inlets on the same side surface of the apparatus body 50, a first high-temperature refrigerant outlet 53*b* and a second high-temperature refrigerant outlet 54*b* are provided. These outlets are located at positions adjacent to each other.

The refrigerant pipe P communicating with the high-temperature-side compressor 5 in the first high-temperature-side refrigeration circuit R1*a* is connected to the first high-temperature refrigerant inlet 53*a*. The refrigerant pipe P communicating with the receiver 7 in the same refrigeration circuit R1*a* is connected to the first high-temperature refrigerant outlet 53*b*.

The refrigerant pipe P communicating with the high-temperature-side compressor 11 in the second high-temperature-side refrigeration circuit R1*b* is connected to the second high-temperature refrigerant inlet 54*a*. The refrigerant pipe P communicating with the high-temperature-side receiver 13 in the same refrigeration circuit R1*b* is connected to the second high-temperature refrigerant outlet 54*b*.

Within the apparatus body 50, the first refrigerant-side flow channel 6*a* communicating with the first high-temperature refrigerant inlet 53*a* and the first high-temperature refrigerant outlet 53*b* is formed. Moreover, the second refrigerant-side flow channel 12*a* communicating with the second high-temperature refrigerant inlet 54*a* and the second high-temperature refrigerant outlet 54*b* is formed.

The first refrigerant-side flow channel 6*a* is composed of main flow channels 55*a* and a plurality of first high-temperature refrigerant branching flow channels 55*b*. The main flow channels 55*a* are connected to the first high-temperature refrigerant inlet 53*a* and the first high-temperature refrigerant outlet 53*b*, and are parallel to each other. The ends of the main flow channels 55*a* are blocked. The plurality of first high-temperature refrigerant branching flow channels 55*b* communicate over the main flow channels 55*a*, and are parallel to each other at predetermined intervals.

The second refrigerant-side flow channel 12*a* is composed of main flow channels 56*a* and a plurality of second high-temperature refrigerant branching flow channels 56*b*. The main flow channels 56*a* are connected to the second high-temperature refrigerant inlet 54*a* and the second high-temperature refrigerant outlet 54*b*, and are parallel to each other. The ends of the main flow channels 56*a* are blocked. The plurality of second high-temperature refrigerant branching flow channels 56*b* communicate over the main flow channels 56*a*, and are parallel to each other at predetermined intervals.

After all, within the apparatus body 50, the water-side branching flow channels 52*b* constituting the water-side flow channel 3, the first high-temperature refrigerant branching flow channels 55*b* constituting the first refrigerant-side flow channel 6*a*, and the second high-temperature refrigerant branching flow channels 56*b* constituting the second refrigerant-side flow channel 12*a* are provided in parallel with each other at predetermined intervals.

In other words, with the water-side branching flow channel 52*b* being interposed, the first high-temperature refrigerant branching flow channel 55*b* is provided on a surface side, and the second high-temperature refrigerant branching flow channel 56*b* is provided on another surface side. The first and second high-temperature refrigerant branching flow channels 55*b* and 56*b* are alternately located with respect to the water-side branching flow channel 52*b*.

The water-refrigerant heat exchanger 2 is formed in this manner. The water or hot water guided from the hot-water pipe H to the water-side flow channel 3 is divided from one of the main flow channels 52*a* into the plurality of water-side branching flow channels 52*b*, is collected in the other main flow channel 52*a*, and comes out from the water-side outlet 51*b*.

In the first high-temperature-side refrigeration circuit R1*a*, the high-temperature refrigerant guided from the first high-temperature refrigerant inlet 53*a* to the first refrigerant-side flow channel 6*a* is divided from one of the main flow channels 55*a* into the plurality of first high-temperature refrigerant branching flow channels 55*b*, is collected in the other main flow channel 55*a* again, and comes out from the first high-temperature refrigerant outlet 53*b*.

In the second high-temperature-side refrigeration circuit R1*b*, the high-temperature refrigerant guided from the second high-temperature refrigerant inlet 54*a* to the second refrigerant-side flow channel 12*a* is divided from one of main flow channels 56*a* into the plurality of second high-temperature refrigerant branching flow channels 56*b*, is collected in the other main flow channel 56*a*, and comes out from the second high-temperature refrigerant outlet 54*b*.

In the water-refrigerant heat exchanger 2, with respect to the plurality of water-side branching flow channels 52*b* which are parallel to each other, the first high-temperature refrigerant branching flow channels 55*b* and the second high-temperature refrigerant branching flow channels 56*b* are alternately provided with a partition being interposed between each of the first high-temperature refrigerant branching flow channels 55*b* and each of the second high-temperature refrigerant branching flow channels 56*b*.

A material which is excellent in thermal conductivity is used for the apparatus body 50 constituting the water-refrigerant heat exchanger 2 and the partition dividing each flow channel. By the flow channel structure of the water-refrigerant heat exchanger 2 explained above and the selection of the structural material, water or hot water, and two high-temperature refrigerants can efficiently exchange heat. Thus, the heat exchange efficiency can be improved.

Each of the water-side inlet 51*a*, the water-side outlet 51*b*, the first high-temperature refrigerant inlet 53*a*, the second high-temperature refrigerant inlet 54*a*, the first high-temperature refrigerant outlet 53*b* and the second high-temperature refrigerant outlet 54*b* may be provided on any side surface of the apparatus body 50, and is not limited at all.

For example, all of the water-side inlet 51*a*, the water-side outlet 51*b*, the first high-temperature refrigerant inlet 53*a*, the second high-temperature refrigerant inlet 54*a*, the first high-temperature refrigerant outlet 53*b* and the second high-temperature refrigerant outlet 54*b* may be provided on the same side surface of the apparatus body 50.

In the combined cascade refrigeration cycle apparatus of FIG. 4, when the requesting performance is deteriorated due to the increase in external temperature or reduction in heating load, the heating performance is reduced by decreasing the operation frequencies of the compressors 5, 11, 18 and 21 in the high-temperature-side refrigeration circuits R1*a* and R1*b* and the low-temperature-side refrigeration circuits R2*a* and R2*b*.

However, it is difficult to decrease the frequencies of the compressors 5, 11, 18 and 21 to the lower limit or less.

Therefore, in the case where the heating performance needs to be further reduced, as the first step, one of the low-temperature-side compressor 18 in the first low-temperature-side refrigeration circuit R2*a* and the low-temperature-side compressor 25 in the second low-temperature-side refrigeration circuit R2*b* on the far side from the pump 1 is stopped.

This simultaneously reduces saturation evaporation temperature and saturation condensation temperature of the refrigerant inside the cascade heat exchangers 9 and 15 in the first high-temperature-side refrigeration circuit R2*a* and the second high-temperature-side refrigerant circuit R2*b* on the far side from the pump 1.

The refrigerant density of absorption of the compressors 5 and 11 in the first and second high-temperature-side refrigeration circuits R1*a* and R1*b* is reduced. Thus, it is possible to further decrease the heating performance by reducing the refrigerant circulation amount of the first and second high-temperature-side refrigeration circuits R1*a* and R1*b*.

As the second step, one of the low-temperature-side compressor 18 in the first low-temperature-side refrigeration circuit R2*a* and the low-temperature-side compressor 25 in the second low-temperature-side refrigeration circuit R2*b* on the side close to the pump 1 is stopped.

This simultaneously reduces saturation evaporation temperature and saturation condensation temperature of the refrigerant inside the cascade heat exchangers 9 and 15 in the first high-temperature-side refrigeration circuit R1*a* and the second high-temperature-side refrigeration circuit R1*b* on the side close to the pump 1. By reducing the refrigerant density of absorption of the compressors 5 and 11 in the first and second high-temperature-side refrigeration circuits R1*a* and R1*b*, the refrigerant circulation amount of the first and second high-temperature-side refrigeration circuits is decreased. Thus, the heating performance can be further reduced.

As the third step, the high-temperature-side compressors 5 and 11 in the first and second high-temperature-side refrigeration circuits R1*a* and R1*b* on the far side from the pump 1, and the low-temperature-side compressor 18 in the first low-temperature-side refrigeration circuit R2*a* or the low-temperature-side compressor 25 in the second low-temperature-side refrigeration circuit R2*b* continuously operated are stopped. (In sum, the refrigeration circuits on the high-temperature-side and low-temperature-side on the far side from the pump 1 are all stopped.) Alternatively, the refrigeration circuits on the high-temperature-side and low-temperature-side on the side close to the pump 1 are all stopped.

In this manner, the heating performance can be further reduced. In other words, it is possible to reduce the minimum capacity at the time of low leading.

Figure 7:
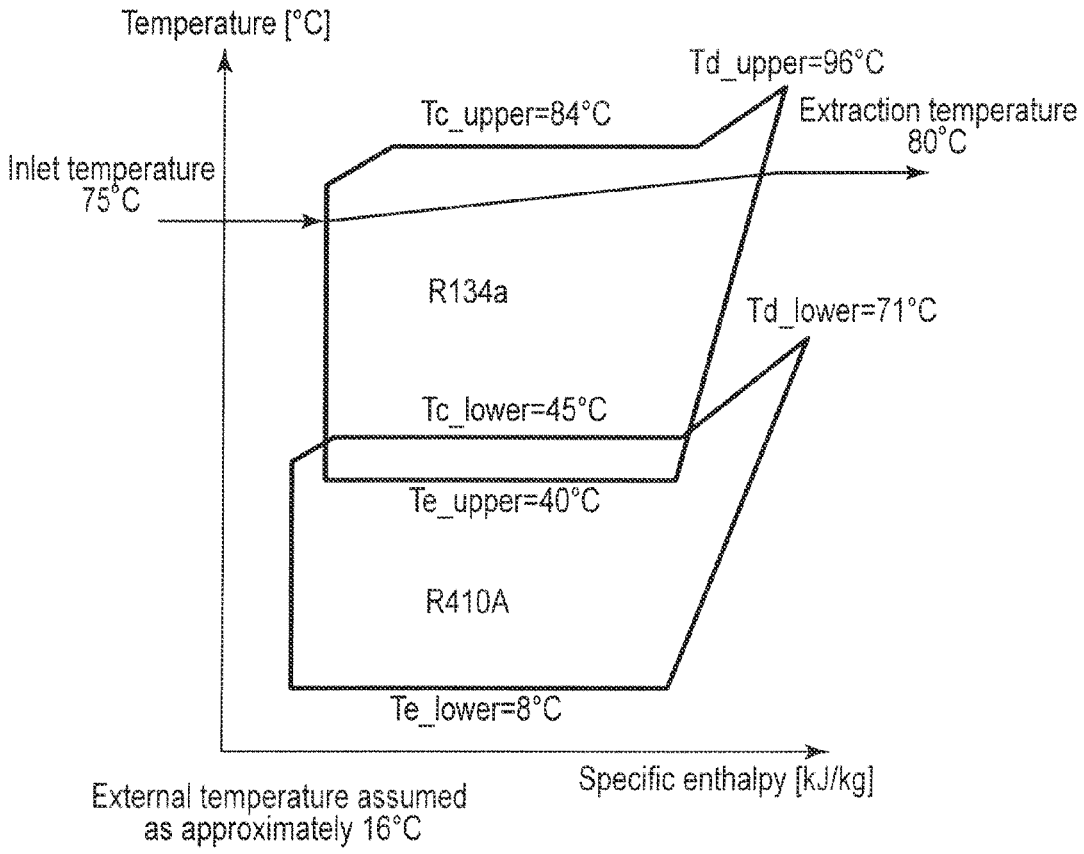
FIG. 7 shows relationships among a condensation temperature, an evaporation temperature and a cascade temperature of a refrigerant used for each embodiment.

As shown in FIG. 7, in the cascade refrigeration cycle apparatus, the condensation temperature of a refrigerant in the high-temperature-side refrigeration circuit is higher than the low-temperature-side refrigeration circuit. Therefore, in the case where R410A is used as a low-temperature-side refrigerant, there is a need to select, as a high-temperature-side refrigerant, a refrigerant which has a temperature similar to R410A, a lower pressure than R410A and a high boiling point.

By the above structure, even if the condensation temperature differs between the low-temperature-side refrigeration circuit and the high-temperature-side refrigeration circuit, the pressure is not very largely different from each other. By refrigeration cycle components whose pressure resistance are similar, the high-temperature-side and low-temperature-side refrigeration circuits can be structured. Thus, the cost performance can be improved.

Figure 8:
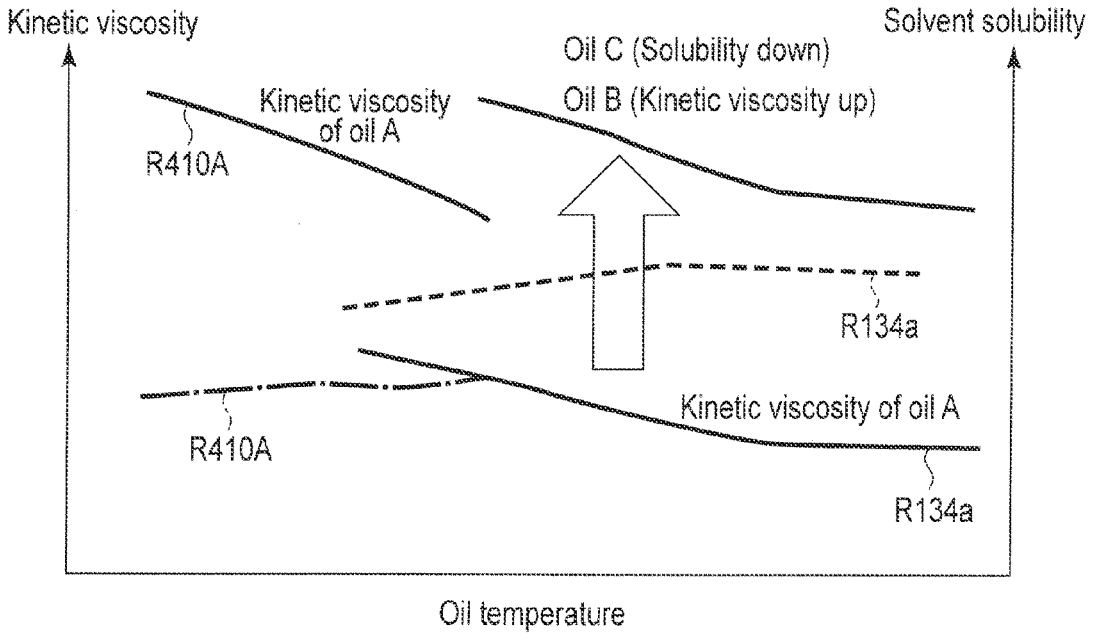
FIG. 8 shows compatibility of a high-temperature-side refrigerant and a low-temperature-side refrigerant which are used for each embodiment, with ice machine oils.

The solubility of a refrigerant relative to ice machine oil is reduced by the increase in temperature of the ice machine oil, and rises up by the increase in pressure. At the time of the actual operation, there is a correlative relationship between condensation temperature (pressure) and oil temperature. Oil temperature is increased as well as condensation temperature. Therefore, as shown in FIG. 8, the refrigerant solubility does not very largely change in the case of the combination of an R410A refrigerant and ester oil.

However, in the case of the combination of an R134*a* refrigerant and ester oil, kinetic viscosity of the oil itself is reduced due to the high oil temperature. The refrigerant solubility relative to oil is large because of good compatibility for ice machine oil. Thus, the kinetic viscosity of ice machine oil of an R134*a* cycle is extremely low compared with an R410A cycle. As a result, in the R134*a* cycle, the amount of discharged oil might be increased. Further, lubrication shortage of a compressor might be caused by shortage of oil-film forming due to reduction in kinetic viscosity of ice machine oil.

In order to solve this problem, the kinetic viscosity of ice machine oil used in the high-temperature-side compressors 5 and 11 may be increased, or the compatibility of the high-temperature-side refrigerant for the high-temperature-side ice machine oil may be reduced. By increasing the kinetic viscosity, a certain level of kinetic viscosity can be ensured even if a refrigerant is blended. As a result, the amount of discharged oil is decreased.

By decreasing compatibility, it is possible to reduce refrigerant solubility, and maintain the high kinetic viscosity at the actual operation state to a certain extent. As a result, the amount of discharged oil is reduced. Thus, it is unnecessary to conduct a special operation such as an oil collection operation.

In sum, the kinetic viscosity of the ice machine oil encapsulated in the above high-temperature-side compressors 5 and 11 and the low-temperature-side compressors 18 and 25 at 40° C. is expressed as high-temperature-side compressors>low-temperature-side compressors. It is possible to inhibit viscosity from reducing in the actual use range, and suppress the reduction in performance to the minimum.

Furthermore, with respect to the ice machine oil encapsulated in the high-temperature-side compressors 5 and 11 and the low-temperature-side compressors 18 and 25, the solubility of each refrigerant for oil is expressed as follows at the similar temperature and pressure: high-temperature-side compressors<low-temperature-side compressors. It is possible to suppress the reduction in viscosity and the increase in the amount of discharged oil in the actual use range. Thus, the reduction in performance can be constricted at minimum.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A combined cascade refrigeration cycle apparatus comprising:

a first high-temperature side refrigeration circuit and a second high-temperature side refrigeration circuit, each comprising a water-refrigerant heat exchanger configured to conduct heat exchange of a refrigerant discharged from a high-temperature-side compressor for water;

a first low-temperature side refrigeration circuit and a second low-temperature side refrigeration circuit, each comprising an evaporator composed of a heat exchanger;

a housing comprising the first high-temperature side refrigeration circuit, the second high-temperature side refrigeration circuit, the first low-temperature side refrigeration circuit and the second low-temperature side refrigeration circuit mounted thereon;

a first cascade heat exchanger comprising a high-temperature refrigerant flow channel, a first low-temperature refrigerant flow channel and a second low-temperature refrigerant flow channel, the high-temperature refrigerant flow channel of the first cascade heat exchanger communicating with the first high-temperature side refrigeration circuit, the first low-temperature refrigerant flow channel of the first cascade heat exchanger communicating with the first low-temperature side refrigeration circuit via a refrigerant pipe;

a second cascade heat exchanger comprising a high-temperature refrigerant flow channel, a first low-temperature refrigerant flow channel and a second low-temperature refrigerant flow channel, the high-temperature refrigerant flow channel of the second cascade heat exchanger communicating with the second high-temperature side refrigeration circuit, the second low-temperature refrigerant flow channel of the second cascade heat exchanger communicating with the second low-temperature side refrigeration circuit via a refrigerant pipe; and a hot-water pipe letting water or hot water through a water-side flow channel of the respective water-refrigerant heat exchangers of the first high-temperature side refrigeration circuit and the second high-temperature side refrigeration circuit, wherein a branching refrigerant pipe diverging from the refrigerant pipe communicating the first low-temperature refrigerant flow channel of the first cascade heat exchanger with the first low-temperature side refrigeration circuit is connected to the first low-temperature refrigerant flow channel of the second cascade heat exchanger, a branching refrigerant pipe diverging from the refrigerant pipe communicating the second low-temperature refrigerant flow channel of the second cascade heat exchanger with the second low-temperature side refrigeration circuit is connected to the second low-temperature refrigerant flow channel of the first cascade heat exchanger, and the first low-temperature side refrigeration circuit and the second low-temperature side refrigeration circuit are controlled in such a way that, when one of the low-temperature side refrigeration circuits conducts a defrosting operation of its evaporator, the other low-temperature side refrigeration circuit releases heat in the first cascade heat exchanger and the second cascade heat exchanger.

2. The combined cascade refrigeration cycle apparatus of claim 1, wherein the water-refrigerant heat exchangers of first high-temperature-side refrigeration circuit and the second high-temperature-side refrigeration circuit are formed as one unit, comprises the water-side flow channel connected to the hot-water pipe, a first refrigerant-side flow channel communicating the first high-temperature-side refrigeration circuit, and a second refrigerant-side flow channel communicating with the second high-temperature-side refrigeration circuit, and is structured by a plate type heat exchanger comprising the first refrigerant-side flow channel on one surface side of the water-side flow channel and the second refrigerant-side flow channel on the other surface side.

3. The combined cascade refrigeration cycle apparatus of claim 1, the apparatus being controlled so as to simultaneously decrease cascade heat exchanger temperature of the first high-temperature-side refrigeration circuit and the second high-temperature-side refrigeration circuit, and obtain reduction in a heating performance, by stopping one of a low-temperature-side compressor in the first low-temperature-side refrigeration circuit and a low-temperature-side compressor in the second low-temperature-side refrigeration circuit when a requesting performance is deteriorated because of increase in external temperature or decrease in heating load.

* * * * *